US008179352B2

(12) United States Patent
Jang et al.

(10) Patent No.: US 8,179,352 B2
(45) Date of Patent: May 15, 2012

(54) GATE DRIVING APPARATUS AND METHOD FOR LIQUID CRYSTAL DISPLAY PANEL

(75) Inventors: Yong Ho Jang, Gwanchun-shi (KR); Cheol Se Kim, Daegu (KR)

(73) Assignee: LG Display Co., Ltd., Seoul (KR)

( * ) Notice: Subject to any disclaimer, the term of this patent is extended or adjusted under 35 U.S.C. 154(b) by 1210 days.

(21) Appl. No.: 10/926,023

(22) Filed: Aug. 26, 2004

(65) Prior Publication Data

US 2005/0156855 A1 Jul. 21, 2005

(30) Foreign Application Priority Data

Feb. 28, 2003 (KR) ..... 10-2003-0012640

(51) Int. Cl.
*G09G 3/36* (2006.01)

(52) U.S. Cl. ..... 345/98

(58) Field of Classification Search ..... 345/98–100
See application file for complete search history.

(56) References Cited

U.S. PATENT DOCUMENTS 5,376,944 A * 12/1994 Mogi et al. ..... 345/100
5,400,050 A * 3/1995 Matsumoto et al. ..... 345/100
5,682,175 A * 10/1997 Kitamura ..... 345/98
6,483,889 B2 * 11/2002 Kim et al. ..... 377/54
2002/0057251 A1 * 5/2002 Higashi ..... 345/100

FOREIGN PATENT DOCUMENTS

JP H07-036415 2/1995

* cited by examiner

*Primary Examiner* — Kevin M Nguyen
*Assistant Examiner* — Cory Almeida
(74) *Attorney, Agent, or Firm* — McKenna, Long and Aldridge, LLP.

(57) ABSTRACT

A gate driving apparatus for a liquid crystal display panel with liquid crystal cells, thin film transistors, gate lines, and data lines includes a plurality of shift registers on the liquid crystal display panel to apply scanning signals to the gate lines, and a gate driving integrated circuit connected to the liquid crystal display panel to generate a plurality of control signals for controlling the shift registers.

8 Claims, 8 Drawing Sheets

GATE DRIVING APPARATUS AND METHOD FOR LIQUID CRYSTAL DISPLAY PANEL

This application claims the benefit of Korean Patent Application No. P2003-12640, filed on Feb. 28, 2003, which is hereby incorporated by reference for all purposes as if fully set forth herein.

BACKGROUND OF THE INVENTION

1. Field of the Invention

This present invention relates to a liquid crystal display, and more particularly to a gate driving apparatus and method for a liquid crystal display panel that is adaptive for reducing the number of external driving integrated circuits connected to the liquid crystal display panel.

2. Discussion of the Related Art

Generally, a liquid crystal display (LCD) controls light transmittance of a liquid crystal having a dielectric anisotropy using an electric field to thereby display a picture. To this end, the LCD includes a liquid crystal display panel having a pixel matrix, and a driving circuit for driving the liquid crystal display panel.

Specifically, as shown in FIG. 1, the LCD includes a liquid crystal display panel 2 having a pixel matrix, a gate driver 4 for driving gate lines GL1 to GLn of the liquid crystal display panel 2, a data driver 6 for driving data lines DL1 to DLm of the liquid crystal display panel 2, and a timing controller 8 for controlling driving timings of the gate driver 4 and the data driver 6.

The liquid crystal display panel 2 includes a pixel matrix consisting of pixels formed for each area defined by the crossing of the gate lines GL and the data lines DL. Each of the pixels includes a liquid crystal cell Clc for controlling light transmission through the pixel according to a pixel signal, and a thin film transistor TFT for driving the liquid crystal cell Clc.

The thin film transistor TFT is turned on when a scanning signal, that is, a gate high voltage VGH from the gate line GL is applied, to thereby pass a pixel signal from the data line DL to the liquid crystal cell Clc. Further, the thin film transistor TFT is turned off when a gate low voltage VGL from the gate line GL is applied, to thereby keep the pixel signal charged in the liquid crystal cell Clc.

The liquid crystal cell Clc acts like a capacitor, and consists of a common electrode separated from a pixel electrode connected to the thin film transistor TFT having a liquid crystal therebetween. The liquid crystal cell Clc further includes a storage capacitor (not shown) so as to stably maintain the charged pixel signal on the pixel until the next pixel signal is charged. The liquid crystal cell Clc changes an alignment state of the liquid crystal having a dielectric anisotropy according to the pixel signal provided through the thin film transistor TFT to control light transmittance through the liquid crystal cell Clc, thereby implementing a gray level scale.

The gate driver 4 shifts a gate start pulse GSP from the timing controller 8 in response to a gate shift clock GSC to thereby sequentially apply a scanning pulse with the gate high voltage VGH to the gate lines GL1 to GLm. The gate driver 4 applies a gate low voltage VGL to the gate lines GL during the remaining intervals in which a scanning pulse with the gate high voltage VGH is not applied. Such a gate driver 4 includes a plurality of gate driving integrated circuits (IC's) as shown in FIG. 2 for the purpose of sharing the driving of the gate lines GL1 to GLn.

The data driver 6 shifts a source start pulse SSP from the timing controller 8 in response to a source shift clock SSC to generate a sampling signal. Further, the data driver 6 latches pixel data RGB input according to the source shift clock SSC in response to the sampling signal and then applies the latched sampling signal line by line in response to a source output enable signal SOE. Next, the data driver 6 converts the pixel data RGB applied line by line into analog pixel signals using different gamma voltages and applies them to the data lines DL1 to DLm. Herein, the data driver 6 determines a polarity of the pixel signal in response to a polarity control signal POL from the timing controller 8 when the pixel data are converted into the pixel signals. Such a data driver 6 includes a plurality of data driving integrated circuits (IC's) for the purpose of driving of the data lines DL1 to DLm.

The timing controller 8 generates a gate start pulse GSP, a gate output enable GOE, and a gate shift clock GSC for controlling the gate driver 4 and a source start pulse SSP, a source shift clock SSC, a source output enable signal SOE and a polarity control signal POL for controlling the data driver 6. In this case, the timing controller 8 generates control signals such as GSP, GSC, GOE, SSP, SSC, SOE and POL using a data enable signal DE to indicate an effective data interval input from the exterior, a horizontal synchronizing signal Hsync, a vertical synchronizing signal Vsync, and a dot clock DCLK to determine the transmission timing of the pixel data RGB.

FIG. 2 shows a plurality of (e.g., four) gate driving IC's 12 included in the gate driver 4 shown in FIG. 1, and FIG. 3 shows input/output waveforms of the gate driving IC's shown in FIG. 2.

Each of the gate driving IC's 12 shown in FIG. 2 is comprised of a shift register for shifting an input start pulse to generate a scanning pulse SP, and a level shifter array having level shifters to level-shift the scanning pulse SP from the shift register and to apply it to the gate line. In this case, a start pulse input into the first gate driving IC 12 is the gate start pulse GSP from the timing controller 8 while start pulses input to the remaining gate driving IC's 12 are carry signals CR1, CR2 and CR3 output from the pre-stage gate driving IC 12. Further, each of the gate driving IC's 12 is commonly supplied with the gate shift clock GSC including a plurality of clocks.

First, the first gate driving IC 12 shifts the gate start pulse GSP in response to the gate shift clock GSC to thereby sequentially apply the scanning pulse SP to the gate lines GL1 to GL(n/4). Then, the first gate driving IC 12 outputs the scanning pulse SP to the last gate line GL(n/4) and, at the same time, applies the carry signal CR1 to the next-stage gate driving IC 12.

The remaining gate driving IC's 12 shifts the carry signals CR1, CR2 and CR3 inputted from the previous gate driving IC 12 in response to the gate shift clock GSC to thereby sequentially apply the scanning signal SP to the gate lines GL(n/4)+1 to GLn as shown in FIG. 3.

The plurality of gate driving IC's 12 is usually mounted on a tape carrier package (TCP) (not shown) that is connected to the liquid crystal display panel 2. In this case, the TCP mounted with the gate driving IC's is attached onto the liquid crystal display panel 2 by a tape automated bonding (TAB) process.

The conventional LCD requires a plurality of gate driving IC's 12 for driving the gate lines GL1 to GLn. Therefore, the number of gate driving IC's 12 and the TCP's must be increased as the number of the gate lines GL1 to GLn is increased in accordance with the resolution, thereby causing a rise in the manufacturing cost.

SUMMARY OF THE INVENTION

Accordingly, it is an object of the present invention to provide a gate driving apparatus and method for a liquid crystal display panel that is adaptive for reducing the number of external driving integrated circuits connected to the liquid crystal display panel.

In order to achieve these and other objects of the invention, a gate driving apparatus for a liquid crystal display panel with liquid crystal cells, thin film transistors, gate lines, and data lines includes a plurality of shift registers on the liquid crystal display panel to apply scanning signals to the gate lines, and a gate driving integrated circuit connected to the liquid crystal display panel to generate a plurality of control signals for controlling the shift registers.

Another embodiment of the present invention includes a method of driving gate lines of a liquid crystal display panel having liquid crystal cells, thin film transistors, gate lines, and data lines including shifting an input gate start pulse using a gate driving integrated circuit connected to the liquid crystal display panel in response to a first gate shift clock to generate a plurality of control signals each having a phase delayed by a first predetermined interval, and carrying out a shift operation sequentially using each of a plurality of shift registers built in the liquid crystal display panel in response to each of the plurality of control signals thereby generating a scanning signal.

Another embodiment of the present invention includes a gate driving apparatus for driving the gate lines of a liquid crystal display panel including a gate driving integrated circuit sequentially generating a plurality of control signals, and a plurality of shift registers on the liquid crystal display panel connected to the gate driving integrated circuit, wherein the shift registers produce scanning signals on the gate lines in response to the plurality of control signals.

Another embodiment of the present invention includes a method of driving gate lines of a liquid crystal display panel including producing a plurality of control signals, and producing a scanning signal using a plurality of shift registers on the liquid crystal display panel in response to the control signals, wherein each shift register receives one of the plurality of control signals.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE ILLUSTRATED EMBODIMENTS

Reference will now be made in detail to the preferred embodiments of the present invention, examples of which are illustrated in the accompanying drawings.

Hereinafter, the preferred embodiments of the present invention will be described in detail with reference to FIGS. 4 to 8.

Figure 1:
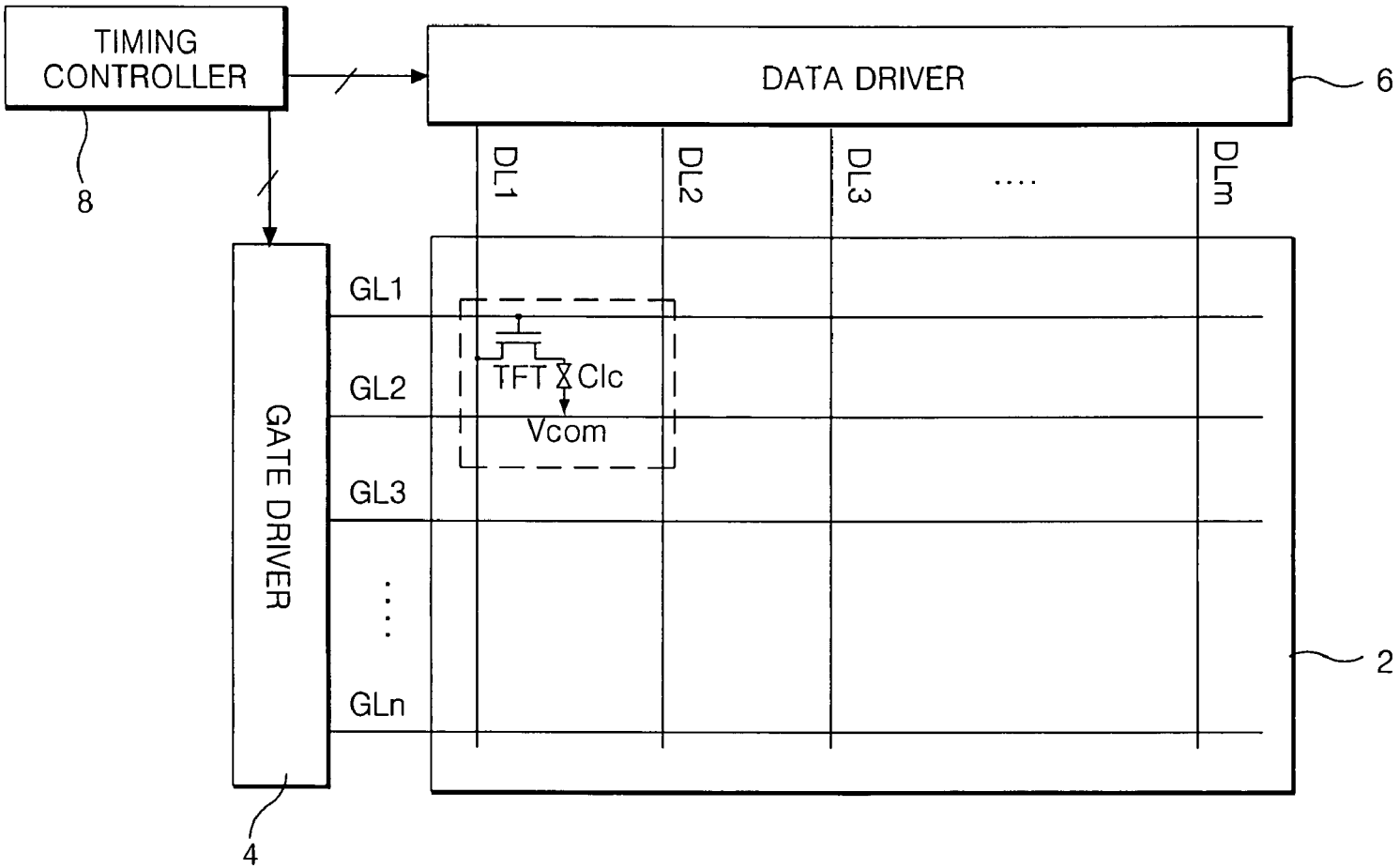
FIG. 1 RELATED ART
FIG. 1 is a schematic block diagram showing a configuration of a conventional liquid crystal display.
Figure 2:
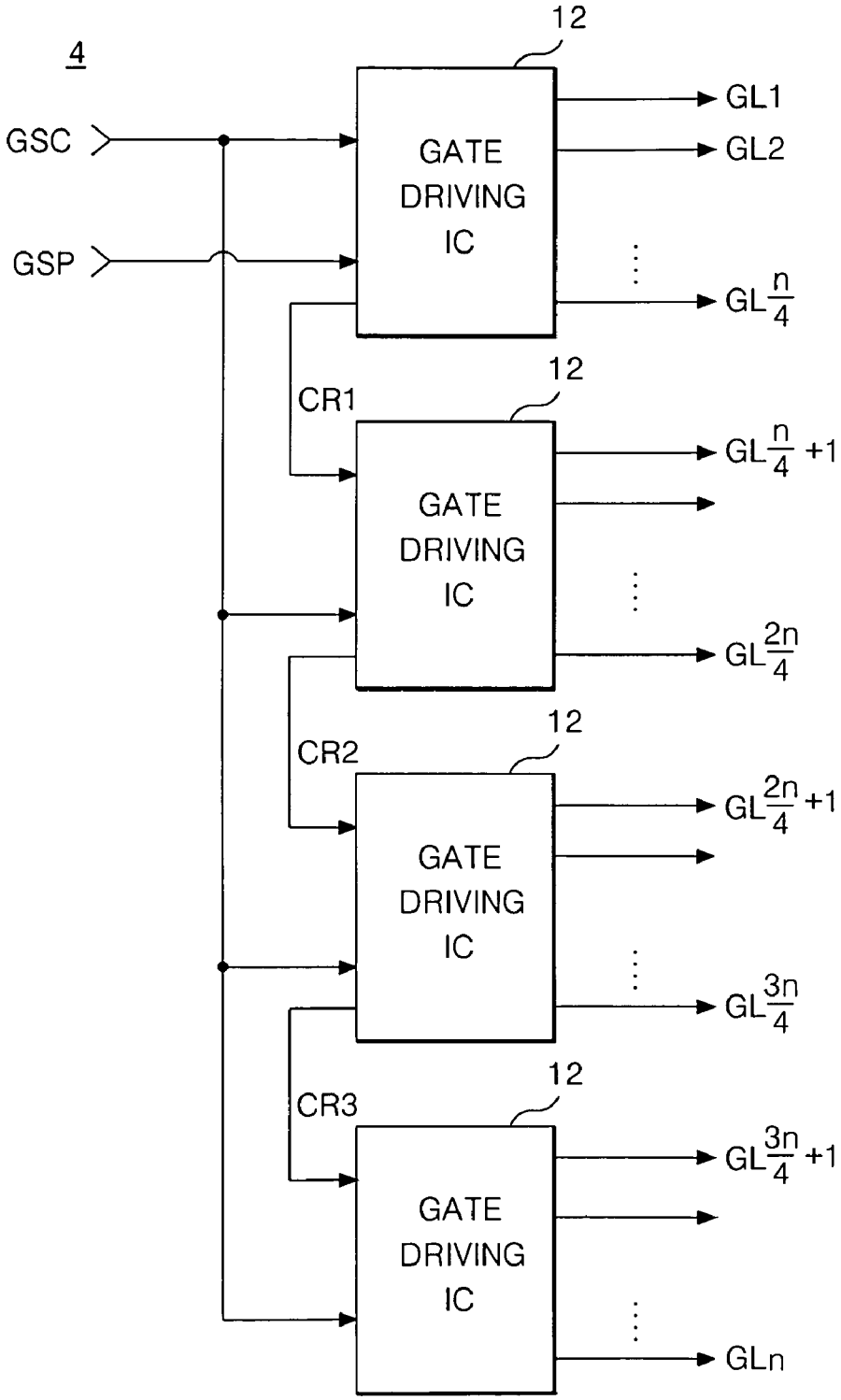
FIG.2 RELATED ART
FIG. 2 is a block diagram showing a detailed configuration of the gate driver shown in FIG. 1.
Figure 3:
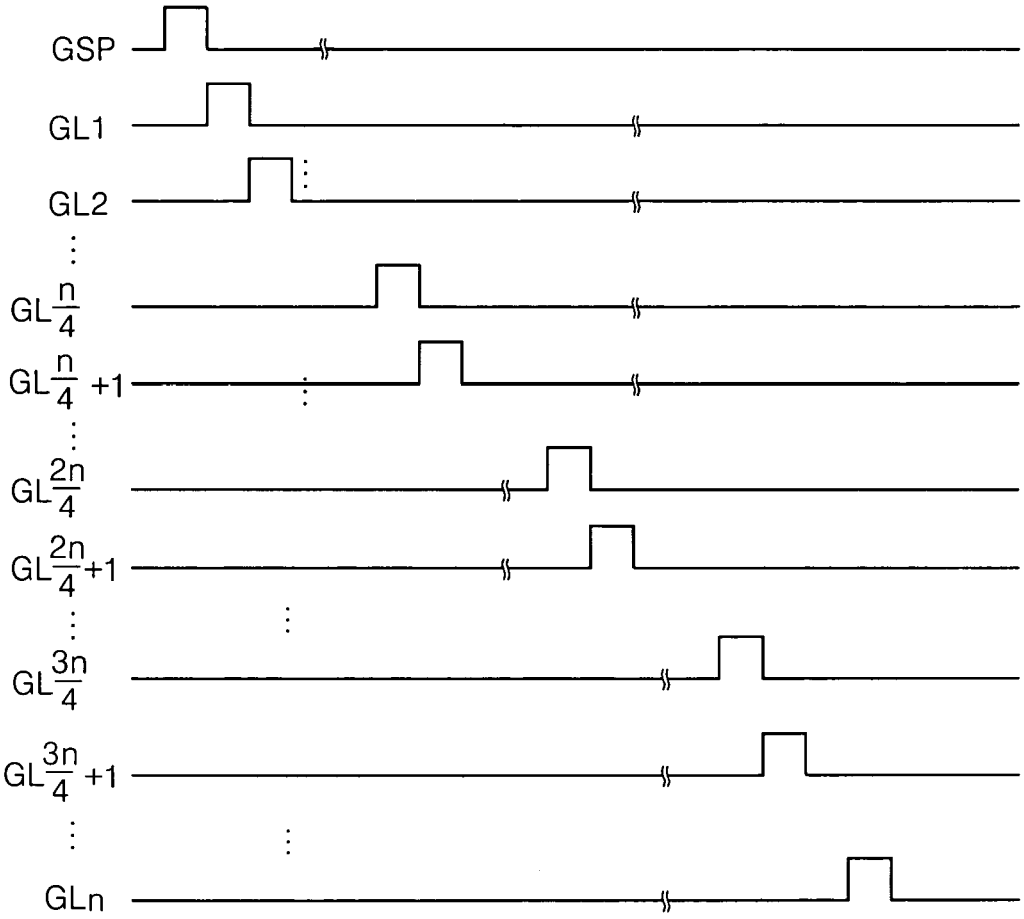
FIG. 3 RELATED ART
FIG. 3 is an input/output waveform diagram of the gate driving IC shown in FIG. 2.
Figure 4:
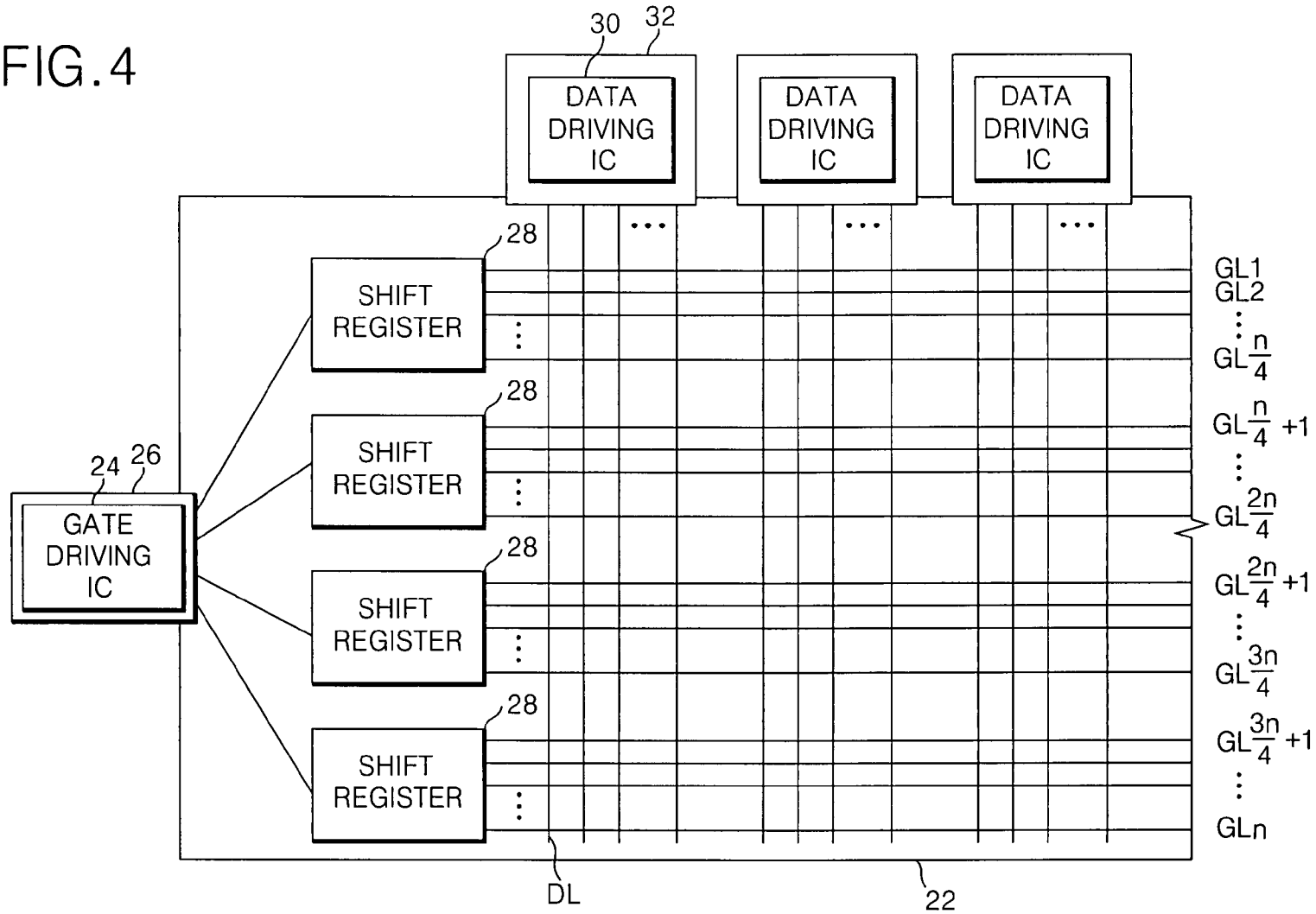
FIG. 4 is a block diagram showing a configuration of a liquid crystal display including a gate driving apparatus according to an embodiment of the present invention.

FIG. 4 shows a configuration of a liquid crystal display including a gate driving apparatus according to an embodiment of the present invention.

Referring to FIG. 4, the liquid crystal display (LCD) includes a liquid crystal display panel 22 having a pixel matrix, a gate driver having a plurality of built-in shift registers 28 and an external gate driving IC 24 to drive gate lines GL1 to GLn of the liquid crystal display panel 22, and data driving IC's 30 to drive data lines DL1 to DLm of the liquid crystal display panel 22.

The liquid crystal display panel 22 includes a pixel matrix including pixels formed at each area defined by intersections between the gate lines GL and the data lines DL. Each of the pixels includes a liquid crystal cell Clc to control the amount of light transmitted according to a pixel signal, and a thin film transistor TFT to drive the liquid crystal cell Clc.

The thin film transistor TFT is turned on when a gate high voltage VGH scanning signal is applied to the gate line GL, to thereby apply a pixel signal from the data line DL to the liquid crystal cell Clc. Further, the thin film transistor TFT is turned off when a gate low voltage VGL from the gate line GL is applied, to thereby keep the pixel signal charged on the liquid crystal cell Clc.

The liquid crystal cell Clc acts like a capacitor, and consists of a common electrode separated from a pixel electrode connected to the thin film transistor TFT having a liquid crystal therebetween. The liquid crystal cell Clc further includes a storage capacitor (not shown) so as to stably maintain the charged pixel signal on the pixel until the next pixel signal is charged. The liquid crystal cell Clc changes an alignment state of the liquid crystal having a dielectric anisotropy according to the pixel signal provided through the thin film transistor TFT to control light transmittance through the liquid crystal cell Clc, thereby implementing a gray level scale.

The gate driver includes a plurality of built-in shift registers that are built in the liquid crystal display panel 22 to sequentially drive the gate lines GL1 to GLn, and one gate driving IC 24 that is mounted on a gate TCP 26 attached to the liquid crystal display panel 22 to control the built-in shift registers 28.

Figure 5:
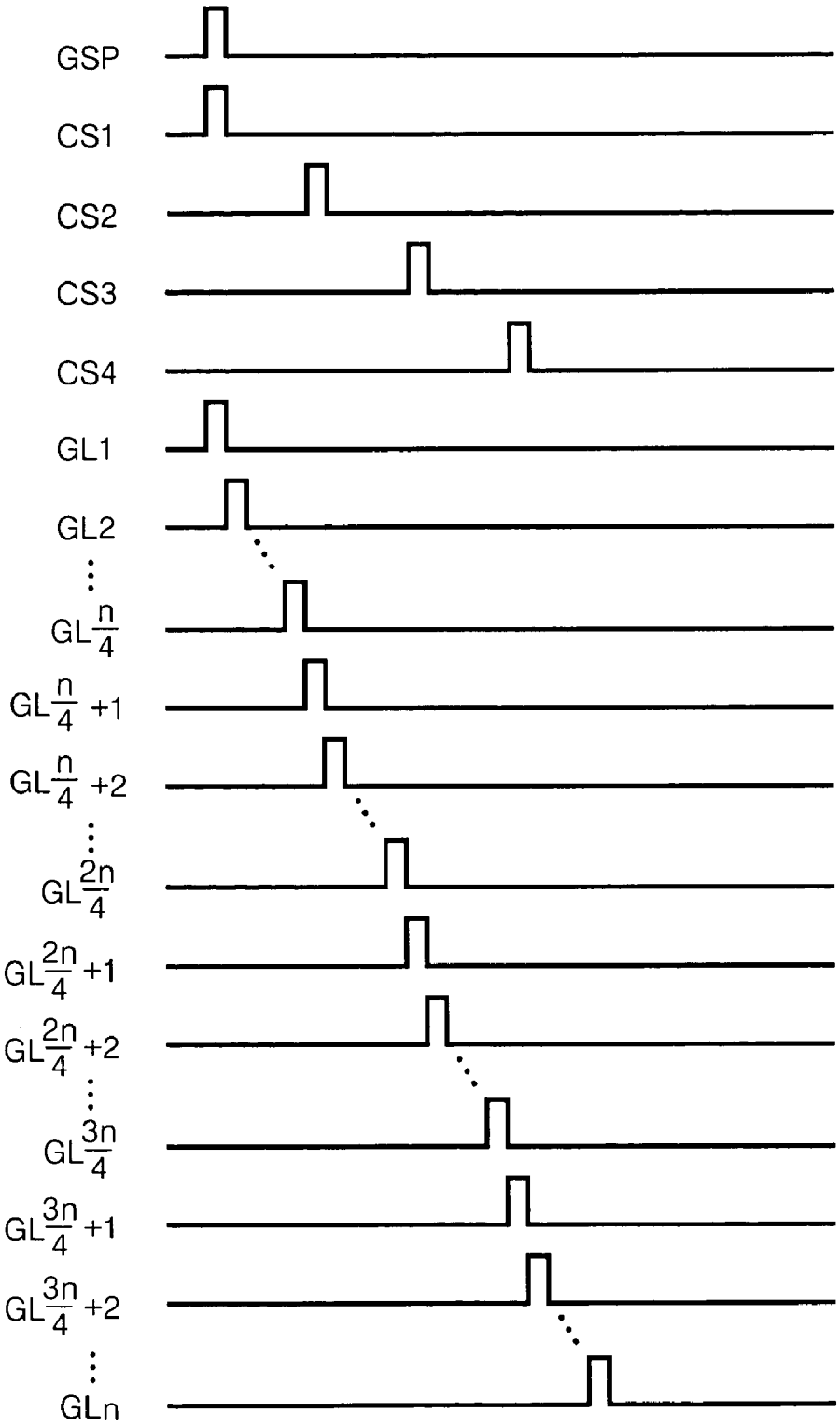
FIG. 5 is an input/output waveform diagram of the gate driving IC and the built-in shift register shown in FIG. 5.
Figure 6:
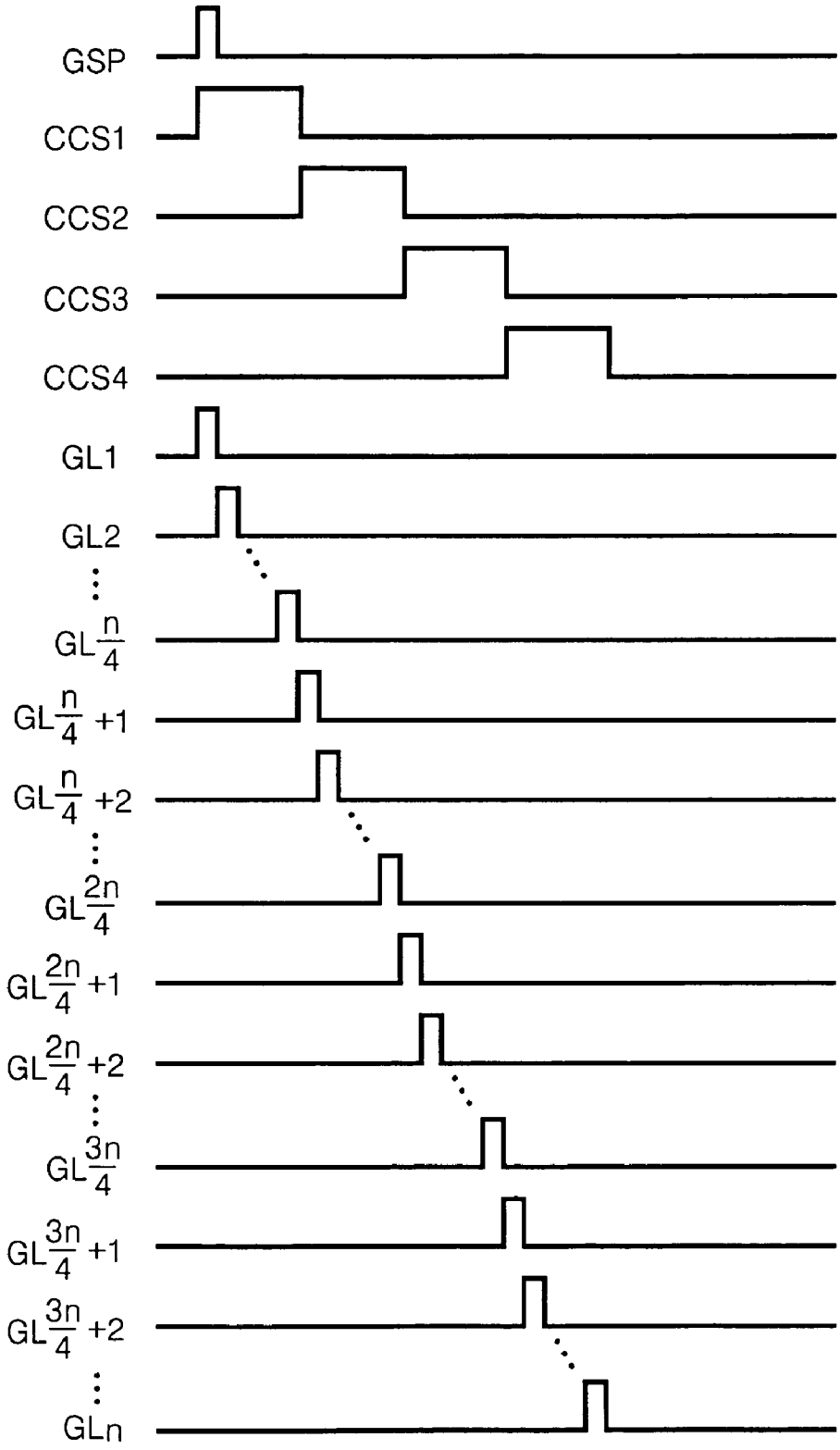
FIG. 6 is other input/output waveform diagram of the gate driving IC and the built-in shift register shown in FIG. 5.

The gate driving IC 24 mounted in the gate TCP 26 includes a shift register for shifting and outputting a gate start pulse GPS from a timing controller (not shown) as shown in FIG. 5 and FIG. 6 in response to a first gate shift clock GSC1, and a level shifter array to level-shift output signals of the shift registers to generate control signals CS1 to CS4 to control the built-in shift registers 28 as shown in FIG. 5 or FIG. 6.

The gate driving IC 24 generates the first to fourth control signals CS1 to CS4 as shown in FIG. 5 in order to sequentially drive the first to fourth built-in shift registers 28. Each of the first to fourth control signals CS1 to CS4 shown in FIG. 5 has a high state in one horizontal period, and has a phase delayed by a time interval so that one built-in shift register 28 is driven at a time. The first to fourth control signals CS1 to CS4 are input to the first to fourth built-in shift registers 28 as a start pulse to initiate the shift operation.

Alternatively, the gate driving IC 24 may generate first to fourth control signals CCS1 to CCS4 as shown in FIG. 6 in order to sequentially drive the first to fourth built-in shift registers 28. Each of the first to fourth control signals CCS1 to CCS4 shown in FIG. 6 has a high state the whole time that the corresponding shift register 28 is on and the signals CCS1 to CCS4 are phase delayed to sequentially activate the built-in shift registers 28. The first to fourth control signals CCS1 to CCS4 are input to the first to fourth built-in shift registers 28 as an enable signal to permit a shift operation.

The first to fourth built-in shift registers 28 built in the liquid crystal display panel 22 sequentially carry out a shift operation in response to the first to fourth control signals CS1 to CS4 from the gate driving IC 24. Thus, the first to fourth built-in shift registers 28 generate a scanning pulse SP for sequentially driving the gate lines GL1 to GLn as shown in FIG. 5 and FIG. 6.

For instance as shown in FIG. 5, the first to fourth built-in shift registers 28 shift and output the respective first to fourth control signals CS1 to CS4 supplied from the gate driving IC 24 in response to a second gate shift clock GSC2 supplied, via the gate TCP 26, from the timing controller (not shown). Thus, the first built-in shift register 28 applies a scanning pulse SP having a gate high voltage VGH to the gate lines GL1 to GL(n/4); the second built-in shift register 28 applies the scanning pulse to the gate lines GL(n/4)+1 to GL(2n/4); the third built-in shift register 28 applies the scanning pulse to the gate lines GL(2n/4)+1 to GL(3n/4); and the fourth built-in shift register 28 applies the scanning pulse to the gate lines GL(3n/4)+1 to GLn. Further, the first to fourth built-in shift registers 28 supply a gate low voltage VGL during the remaining intervals in which the scanning pulse SP with the gate high voltage is not applied.

Alternatively, the first to fourth built-in shift registers 28 carry out a shift operation in response to the second gate shift clock GSC2 supplied, via the gate TCP 26, from the timing controller (not shown) in a time interval corresponding to the first to fourth control signals CCS1 to CCS4 as shown in FIG. 6. Thus, the first built-in shift register 28 applies a scanning pulse SP having a gate high voltage VGH to the gate lines GL1 to GL(n/4); the second built-in shift register 28 applies it to the gate lines GL(n/4)+1 to GL(2n/4); the third built-in shift register 28 applies it to the gate lines GL(2n/4)+1 to GL(3n/4); and the fourth built-in shift register 28 applies it to the gate lines GL(3n/4)+1 to GLn. Further, the first to fourth built-in shift registers 28 supply a gate low voltage VGL during the remaining intervals in which the scanning pulse SP with the gate high voltage VGH is not applied.

A plurality of data driving IC's 30 to drive the data lines DL1 to DLm is mounted on a data TCP 32 to be attached onto the liquid crystal display panel 22. Each of the data driving IC's 30 converts digital pixel data from the timing controller (not shown) into analog pixel signals to apply them to the corresponding data lines.

Figure 7:
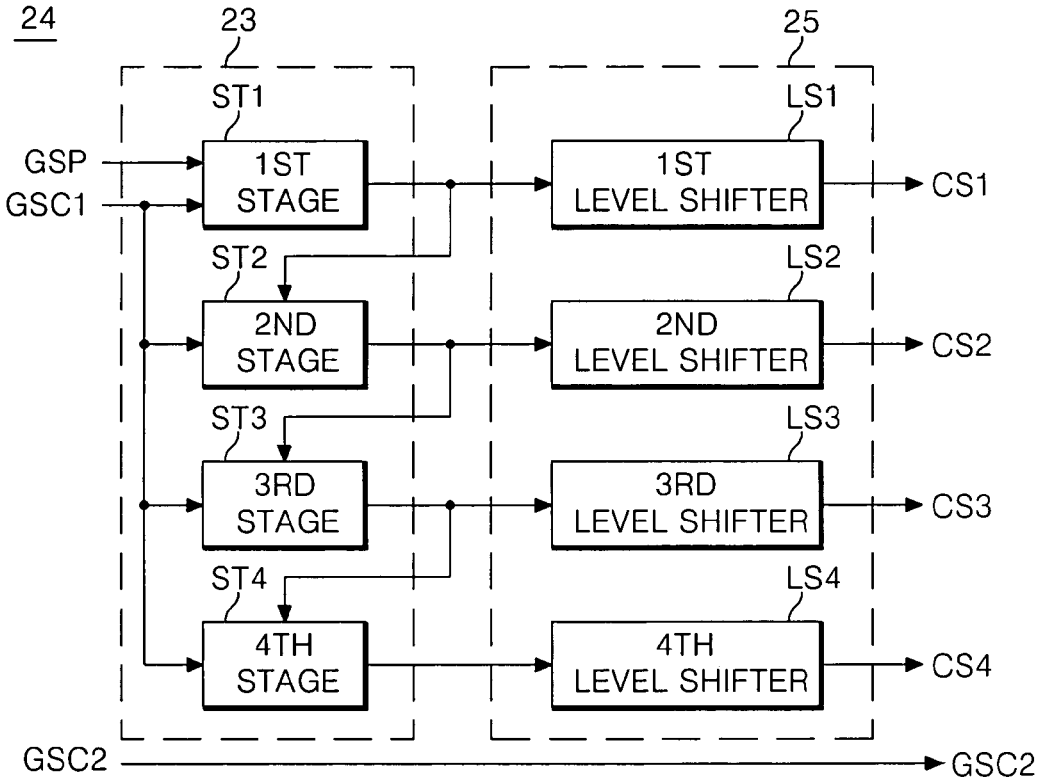
FIG. 7 is a block diagram showing a detailed configuration of the gate driving IC shown in FIG. 4.

FIG. 7 shows a more detailed configuration of the gate driving IC shown in FIG. 4.

Referring to FIG. 7, the gate driving IC 24 includes a shift register 23 having a plurality of stages ST1 to ST4, and a level shifter array 25 having level shifters LS1 to LS4 connected to output lines of the respective stages ST1 to ST4.

The first stage ST1 of the shift register 23 receives the gate start pulse GSP from the timing controller (not shown) while the second to fourth stages ST2 to ST4 receive an output signal of the previous stage. Further, the stages ST1 to ST4 all receive the first gate shift clock GSC1 from the timing controller (not shown). Herein, the first gate shift clock GSC1 includes a plurality of clock signals. The stages ST1 to ST4 sequentially shift and output the gate start pulse GSP.

The level shifters LS1 to LS4 level-shift shift signals output from the respective stages ST1 to ST4 to generate the first to fourth control signals CS1 to CS4 as shown in FIG. 5 or the first to fourth control signals CCS1 to CCS4 as shown in FIG. 6.

Figure 8:
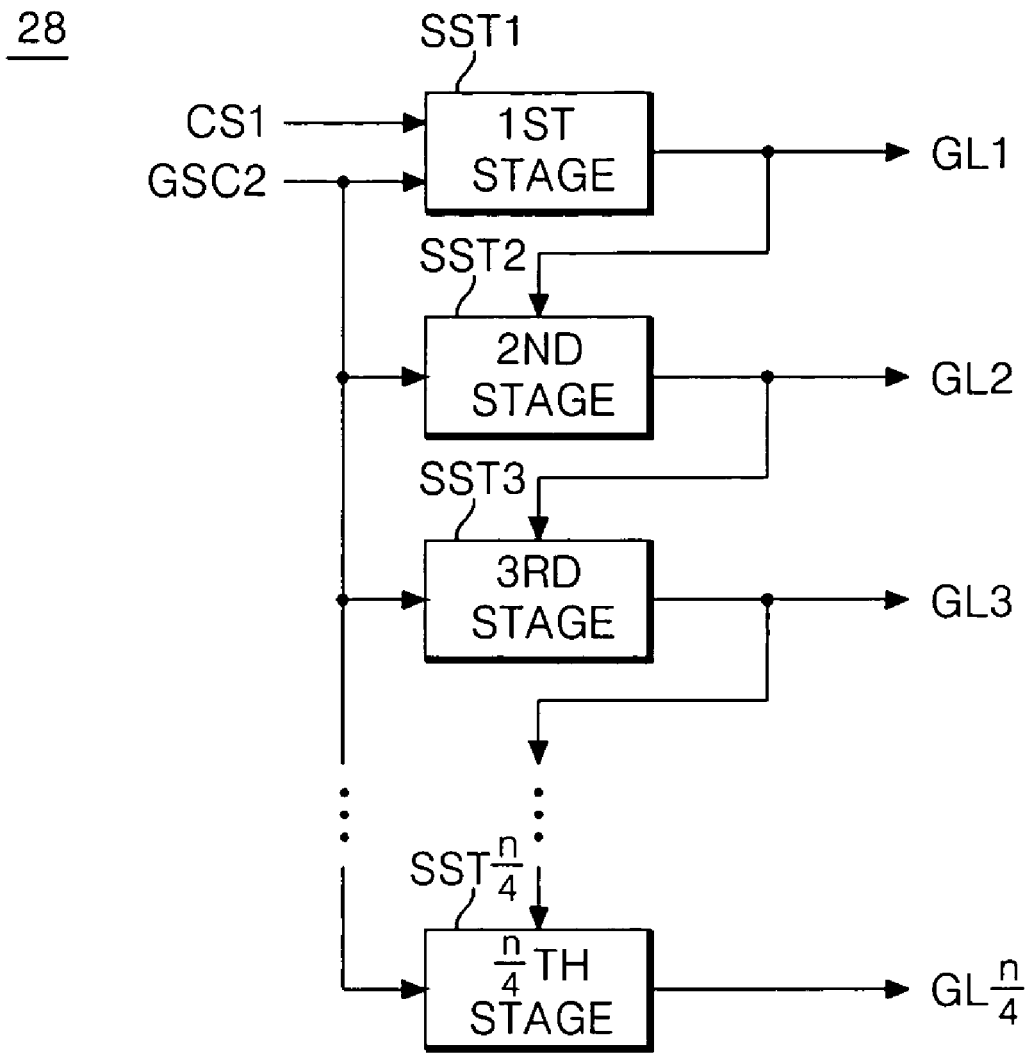
FIG. 8 is a block diagram showing a detailed configuration of the built-in shift register shown in FIG. 4.

FIG. 8 shows a detailed configuration of the built-in shift register 28 shown in FIG. 4.

Referring to FIG. 8, the built-in shift register 28 includes a plurality of stages SST1 to SST(n/4).

The stages SST1 to SST(n/4) shown in FIG. 8 shift and output control signals CS as shown in FIG. 5 input from the gate driving IC 24 in response to the second gate shift clock GSC2 supplied, via the gate TCP 26, from the timing controller (not shown).

Alternatively, the stages SST1 to SST(n/4) shown in FIG. 8 carry out a shift operation in a time interval when control signals CCS as shown in FIG. 6 are input from the gate driving IC 24 in response to the second gate shift clock GSC2 supplied via the gate TCP 26 from the timing controller (not shown).

Accordingly, the built-in shift register 28 sequentially drives the gate lines connected thereto.

As described above, according to the present invention, the gate lines are driven by a single gate driving IC and the built-in shift register built in the liquid crystal display panel. Accordingly, it becomes possible to reduce the number of gate driving IC's as well as the number of TCP's mounted with the IC's, thereby reducing the manufacturing cost.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A gate driving apparatus for a liquid crystal display panel with liquid crystal cells, thin film transistors, gate lines, and data lines comprising:

a timing controller generating a gate start pulse, a first gate shift clock and a second gate shift clock;

a gate driving integrated circuit (IC) sequentially generating a plurality of control signals in response to the gate start pulse and the first gate shift clock, wherein the gate driving IC mounted on a circuit film, connected to the liquid crystal panel, includes:

a first shift register including a plurality of first stages connected in cascade and carrying out a first shift operation using the gate start pulse and the first gate shift clock, so as to sequentially generate the plurality of control signals; and a level shifter array level-shifting and outputting the plurality of control signals from the first shift register, register, wherein an output of one of the first stages is directly connected to both another first stage of the first shift register and the level shifter array; and a plurality of second shift registers built in the liquid crystal display panel, wherein each of the second shift registers includes a plurality of second stages connected in cascade and carries out a second shift operation, each second shift register receiving one of the plurality of control signals from the level shifter array of the gate driving IC and providing scanning signals to at least two of the gate lines, wherein the timing controller supplies the first gate shift clock to the gate driving IC and supplies the second gate shift clock to the second shift registers, wherein the second gate shift clock is supplied to the plurality of second shift registers via the circuit film from the timing controller, and wherein the number of the plurality of control signals from the level shifter array is the same as the number of the plurality of second shift registers.

2. The gate driving apparatus according to claim 1, wherein the gate driving IC shifts the gate start pulse in response to the first gate shift clock signal to generate the plurality of control signals having a phase sequentially delayed by a predetermined interval from a previous control signal, and the gate driving IC applies the generated control signals to the respective second shift registers.

3. The gate driving apparatus according to claim 2, wherein each of the second shift registers receives a corresponding control signal from the gate driving IC as a start pulse, and shifts the start pulse in response to the second gate shift clock signal from the timing controller to generate the scanning signal.

4. The gate driving apparatus according to claim 2, wherein each of the second shift registers carries out the second shift operation using the second gate shift clock signal supplied via the gate driving IC from the timing controller during an enable interval of the corresponding control signal from the gate driving IC thereby generating the scanning signal.

5. The gate driving apparatus according to claim 1, wherein each of the second shift registers sequentially carries out the second shift operation.

6. A method of driving gate lines of a liquid crystal display panel having liquid crystal cells, thin film transistors, gate lines, and data lines comprising:

generating a gate start pulse, a first gate shift clock and a second gate shift clock using a timing controller;

carrying out a first shift operation using a first shift register of a gate driving IC connected to the liquid crystal display panel in response to the gate start pulse and the first gate shift clock to sequentially generate a plurality of control signals wherein the first shift register includes a plurality of first stages connected in cascade;

level-shifting and outputting the plurality of control signals using a level shifter array of the gate driving IC, wherein an output of one of the first stages is directly connected to both another first stage of the first shift register and the level shifter array; and carrying out a second shift operation sequentially using each of a plurality of second shift registers built in the liquid crystal display panel, wherein each the second shift register includes a plurality of second stages connected in cascade, each second shift register receiving one of the plurality of control signals from the level shifter array of the gate driving IC and providing scanning signals to at least two of the gate lines, wherein the timing controller supplies the first gate shift clock to the gate driving IC and supplies the second gate shift clock to the second shift registers, wherein the gate driving IC is mounted on a circuit film connected to the liquid crystal panel, wherein the second gate shift clock is supplied to the plurality of second shift registers via the circuit film from the timing controller, and wherein the number of the plurality of control signals from the level shifter array is the same as the number of the plurality of second shift registers.

7. The method according to claim 6, wherein generating the scanning signal includes receiving the corresponding supplied control signal as a start pulse and shifting the start pulse in response to the second gate shift clock signal.

8. The method according to claim 6, wherein generating the scanning signal includes carrying out the second shift operation using the second gate shift clock signal input during an enable interval of the corresponding supplied control signal.

* * * * *